US011230683B2

(12) United States Patent
Faye et al.

(10) Patent No.: US 11,230,683 B2
(45) Date of Patent: Jan. 25, 2022

(54) USE OF OILS COMPRISING NON-NEUROTOXIC ANTI-WEAR ADDITIVES

(71) Applicant: NYCO, Paris (FR)

(72) Inventors: Djibril Faye, Eragny (FR); Marion Gay, Cergy (FR); Florence Severac, Gargenville (FR); Jean-Louis Mansoux, Le Plessis-Bouchard (FR); Grégoire Herve, Paris (FR)

(73) Assignee: NYCO, Paris (FR)

( * ) Notice: Subject to any disclaimer, the term of this patent is extended or adjusted under 35 U.S.C. 154(b) by 0 days.

(21) Appl. No.: 16/878,857

(22) Filed: May 20, 2020

(65) Prior Publication Data

US 2021/0363455 A1 Nov. 25, 2021

(51) Int. Cl.

| | |
|---|---|
| ***C10M 137/04*** | (2006.01) |
| ***C10M 105/32*** | (2006.01) |
| ***C10N 40/13*** | (2006.01) |
| ***C10N 30/06*** | (2006.01) |
| ***C10N 30/10*** | (2006.01) |

(52) U.S. Cl.

CPC ..... *C10M 137/04* (2013.01); *C10M 105/32* (2013.01); *C10M 2207/2805* (2013.01); *C10M 2223/04* (2013.01); *C10N 2030/06* (2013.01); *C10N 2030/10* (2013.01); *C10N 2040/13* (2013.01)

(58) Field of Classification Search

CPC ..... C10M 105/32; C10M 137/04; C10M 2207/2805; C10M 2223/04; C10N 2030/04; C10N 2030/06; C10N 2040/13

See application file for complete search history.

(56) References Cited

U.S. PATENT DOCUMENTS

| | | | | |
|---|---|---|---|---|
| 5,503,761 | A * | 4/1996 | Ashcraft, Jr. | C10M 105/38 508/485 |
| 5,560,849 | A * | 10/1996 | Shankwalkar | C10M 105/38 508/423 |
| 8,623,795 | B2 * | 1/2014 | Douglass | C10M 169/041 508/423 |
| 2010/0305011 | A1 | 12/2010 | Frapin et al. | |
| 2011/0306530 | A1 | 12/2011 | Manabe et al. | |
| 2012/0101015 | A1 | 4/2012 | Frapin et al. | |

(Continued)

FOREIGN PATENT DOCUMENTS

| | | | |
|---|---|---|---|
| EP | 0612837 | A1 | 8/1994 |
| FR | 2924122 | A1 | 5/2009 |
| WO | 96/20263 | A1 | 7/1996 |

(Continued)

OTHER PUBLICATIONS

Michaelis et al., "Aerotoxic Syndrome: A New Occupational Disease?", Public Health Panorama, 2017, pp. 198-211, vol. 3, No. 2.

(Continued)

*Primary Examiner* — James C Goloboy

(74) *Attorney, Agent, or Firm* — Nixon & Vanderhye

(57) ABSTRACT

The invention relates to the use of an oil that does not include tricresyl phosphate and includes as an anti-wear additive at least one diphosphorus compound for the prophylaxis of aerotoxic syndrome, especially in case of fume event. It also relates to the oil as such.

9 Claims, 1 Drawing Sheet

(56) References Cited

U.S. PATENT DOCUMENTS

| | | | |
|---|---|---|---|
| 2012/0329693 | A1 | 12/2012 | Umehara et al. |
| 2016/0002565 | A1 | 1/2016 | Schmid et al. |

FOREIGN PATENT DOCUMENTS

| | | | |
|---|---|---|---|
| WO | 2009/071857 | A1 | 6/2009 |
| WO | 2010/149690 | A1 | 12/2010 |
| WO | 2012/015873 | A1 | 2/2012 |
| WO | 2015/026566 | A1 | 2/2015 |

OTHER PUBLICATIONS

Aldridge et al., "Tricresyl phosphates and cholinesterase", Biochemical Journal, 1954, pp. 185-189, vol. 56, No. 2.

Van Der Veen et al., "Phosphorus flame retardants: Properties, production, environmental occurrence, toxicity and analysis," Chemosphere, Pergamon Press, Oxford, GB, vol. 88, No. 10, Mar. 26, 2012, pp. 1119-1153.

Notification of the RRP with obligation to respond with annex Preliminary Search Report issued in French Patent Application No. FR2005253 dated Dec. 18, 2020.

* cited by examiner

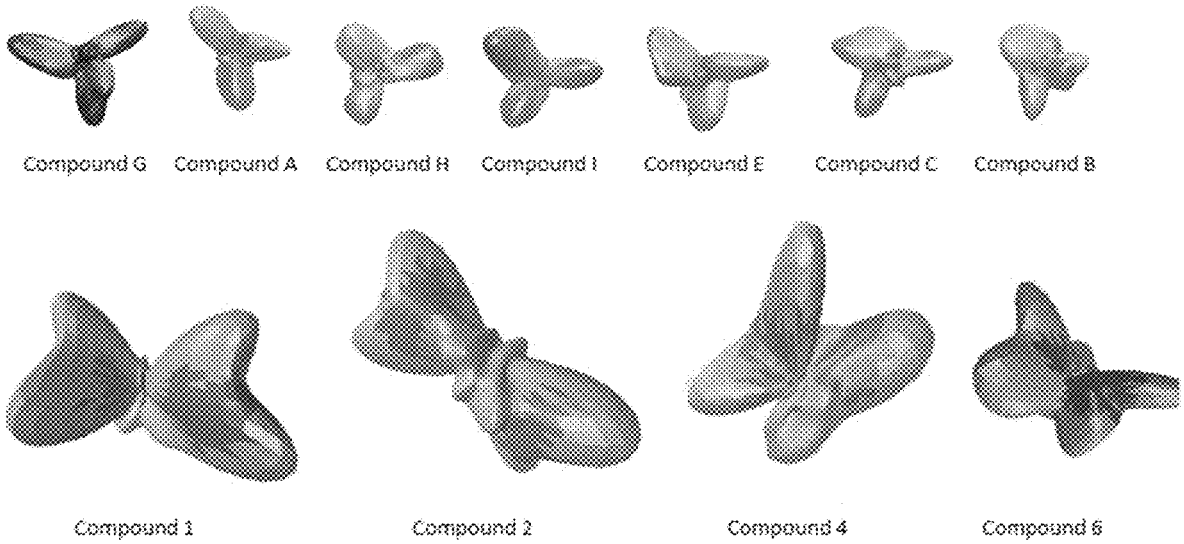
Compound G
Compound A
Compound H
Compound I
Compound E
Compound C
Compound B
Compound 1
Compound 2
Compound 4
Compound 6

USE OF OILS COMPRISING NON-NEUROTOXIC ANTI-WEAR ADDITIVES

TECHNICAL FIELD

The present invention relates to the technical field of anti-wear additives used in oils such as oils for lubricating aircraft or aeroderivative turbines or hydraulic oils.

TECHNOLOGICAL BACKGROUND

Aircraft or aeroderivative turbine engines use synthetic lubricants generally comprising an ester base and a variety of anti-wear additives from the family of organophosphates such as triaryl phosphates. The most commercially used anti-wear additive is tricresyl phosphate (TCP), which has singular anti-wear properties that can be considered as unique to date. Its triaryl phosphate analogs are also interesting anti-wear additives.

Leakage of lubricants, especially those containing tricresyl phosphate or a triaryl phosphate analog thereof, in the aircraft cabin air may originate from worn or faulty seals, or even under normal conditions of use by the passage of the lubricants in the air for pressurizing the cabin. These repeated leaks are explained (Michaelis S. et al. *Public Health Panorama* 2017, 3, 2, p 198-211) as being due to pressure oscillations between the bearing chamber and the air circuit exerted by the normal operating conditions (increase in engine power, take-off . . . ). In some circumstances, the leak can become very significant, usually subsequent to the break of a bearing in the turbine, the latter leading to a fume event or a white mist visible in the cabin.

Aerotoxic syndrome is a pathological condition combining physical and neurological symptoms caused by short- and long-term effects of an exposure to aircraft cabin air contaminated by hydraulic oils or engine oils or any other organic pollutant found as gases and/or aerosols. The reported symptoms are typically non-specific, and the cabin air quality monitoring studies indicate contaminant levels which are lower than the limits of exposure and not harmful to human health, the challenge being to measure continuously and in operation fumes from oils, by definition non-gaseous, airborne, which deposit and concentrate episodically at various locations in the aircraft (Kasper Solbu et al. *J. Environ. Monit.* 2011, 13, 1393).

Symptoms similar to those of the aerotoxic syndrome can also be observed in environments on the ground in the presence of aeroderivative turbines, for example on offshore platforms. Aeroderivative turbines operate in the same way as aircraft turbines and are implementing lubricants of similar composition, especially in terms of anti-wear agents.

Nevertheless, a number of studies (Michaelis, S. et al. *Public Health Panorama* 2017, 3, 2, p. 196-211) have demonstrated a relative causal relationship between acute and/or chronic exposure to substances contaminating the aircraft cabin air and neurological, neurobehavioral and respiratory symptoms.

Conventional organophosphate anti-wear additives such as tricresyl phosphate (TCP), especially the tri-orthocresyl phosphate (ToCP) isomer thereof, are known to have a strong neurotoxic effect (Craig P. et al. *Journal of Toxicology and Environmental Health* Part B: Critical Reviews 1999, 2, 4, p. 281-300). Beyond the generic toxicity associated with the organophosphates widely used in various fields, particularly as insecticides and pesticides, one of the specified and recognized reasons for this neurotoxic effect is the fast in vivo conversion of tricresyl phosphate isomers comprising at least one ortho substitution into a metabolite called saligenin which is a potent inhibitor of cholinesterases. ToCP poisoning leads to a pathology called organophosphate-induced delayed neuropathy (OPIDN) whose mechanism has been extensively studied.

Oils comprising, as an anti-wear additive, TCP which does not include ortho isomer have been developed. Nevertheless, despite the absence of ToCP in the TCP, the inhibition level of cholinesterases in the rat serum exposed to TCP is not zero and, although low, it is persistent (Mackerer C R et al. *J. Toxicol. Env. Health* Part A 1999 57(5): 293-328). Similarly, earlier works show problems of spinal cord demyelination resulting from exposure to TCP in its meta and para forms (W. N. Aldridge, *Biochemical Journal* 1954 56, 185-189).

Very recent studies show that tricresyl phosphate and its tri-aryl phosphate analogs also act on other biological targets, especially at the cellular level (AV Terry, *Pharmacology and Therapeutics* 2012, 134, p. 355-365: Al Salem et al. *Chemosphere* 2019, 237, 124519).

All of these studies and this long history constitute a body of evidence and elements which made the tricresyl phosphate and its tri-aryl phosphate analogs additives of particular concern. In order to increase the safety level of hydraulic oils and oils used in aircraft and aeroderivative turbines, it seems to be useful to develop alternative anti-wear additives to tricresyl phosphate and its tri-aryl phosphate analogs.

Identification of alternative anti-wear additives to tricresyl phosphate and its tri-aryl phosphate analogs is an identified issue, even if there is no unanimity on the need to obviate tricresyl phosphate and its tri-aryl phosphate analogs. To the Applicant's knowledge, no studies have identified alternative anti-wear additives having both satisfactory anti-wear effect and proven non-neurotoxicity. As an example, recent studies on the characterization of the potential neurotoxicity of new organophosphates developed and marketed as new generation flame retardants are for the most part of a level of hazard allegedly equivalent to that of usual materials like the TCP (Zhang et al. *Neurotoxicology and Teratology* 2019, 73, p. 54-66, Ryan et al. *Neurotoxicology* 2016, 53, 271-281, Sirenko et al. *Toxicolog. Sci.* 2019, 167, p. 58-76). The issue of organophosphorus compound neurotoxicity remains unanswered and unresolved to date.

Furthermore, the TCP being also known to be reprotoxic, the development of alternative anti-wear additives to tricresyl phosphate and its tri-aryl phosphate analogs, for which lack of neurotoxicity and reprotoxicity would be established, would be advantageous and would make it possible to increase the safety level in the aviation and other aeroderivative applications.

The patent application US2016/0002565 discloses a turbine oil free of tricresyl phosphate which comprises at least one basic oil, at least one alkyl polyglycoside and a phenolic derivative such as 3,5-di-tert-butyl-hydroxytoluene. Replacing tricresyl phosphate with phenolic derivative helps to prevent aerotoxic syndrome when this oil is used in aircraft turbines. Nevertheless, the implementation of such an oil in aircraft turbines seems not to be able to provide the same effectiveness as that of the oil containing tricresyl phosphate it is supposed to replace, on one hand because the described formulation does not include any agent having an anti-wear effect replacing that of the TCP, and on the other hand because the formulation comprises alkyl polyglycosides which are heat-sensitive.

So far, only phosphorus compounds showed efficient effectiveness as anti-wear agents in oils for aircraft or aeroderivative turbines. Without intending to be bound by any theory, this may be related to the fact that the phosphorus enables the formation of a protective layer, commonly referred to as tribofilm, even at the high temperatures involved by the intended applications.

The patent application WO2010/149690 discloses the reduced effect on butyrylcholinesterase, especially in relation to TCP, of specific triaryl phosphates wherein the phenyl moieties are substituted by one to three isopropyle or tert-butyl moieties. These inhibition results suggest a possible reduction in neurotoxicity associated with these compounds compared to that observed for the TCP. Nevertheless, the simple demonstration of a limited effect on a single cholinesterase seems not to be enough to ensure a sufficient safety level for aviation expectations.

Disclosure of the Invention

In that context, the Applicant showed that diphosphorus compounds, especially arylic diphosphorus compounds, which have satisfactory, or improved, anti-wear and thermal stability properties, have a significantly reduced, or no, neurotoxicity in comparison with that of the monophosphate anti-wear derivatives such as TCP, and can therefore be advantageously used in oils, particularly for lubricating aircraft or aeroderivative turbines, for the prophylaxis of aerotoxic syndrome, especially in case of fume event. The anti-wear properties of some diphosphorus compounds, which are aryl diphosphates, have for example been shown in the prior art, especially in the patent applications WO96/20263, US2012/0329693, WO2012/015873, EP 0612837 and WO2015/026566 or in the publication Zhao et al. Ind. Eng. Chem. Res. 2013, 52, 22, 7419-7424.

While the use of diphosphorus compounds such as aryl diphosphates as anti-wear additives has already been considered in the prior art, to the Applicant's knowledge, no study has been able to demonstrate their non-neurotoxicity and, therefore their interest to prevent aerotoxic syndrome. Furthermore, the Applicant also showed the lack of reprotoxicity of diphosphorus compounds, which reinforces their interest as an alternative to the TCP as anti-wear agent in oils such as hydraulic oils or turbine oils.

SUMMARY OF THE INVENTION

Thus, the present invention relates to the use of an oil that does not include tricresyl phosphate and includes as anti-wear additive at least one diphosphorus compound of the formula (I):

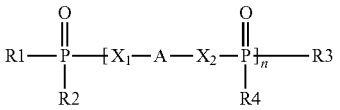

wherein each of R1, R2, R3 and R4 is independently an alkyl or aryl group or an O-alkyl or O-aryl group, A is an alkyl, aryl or aralkyl group, each of $X_1$ and $X_2$ is independently a single bond, an oxygen atom or a nitrogen atom, and n is an integer ranging between 1 and 5, for the prophylaxis of aerotoxic syndrome.

The compounds of the formula (I) have interesting anti-wear properties which may be comparable to those of the tricresyl phosphate or its triaryl phosphate analogs. They also have a very low, or no, risk level in terms of toxicity. Thus, they are non-toxic in terms of action on cholinesterases, non-neurotoxic and non-reprotoxic.

The invention also relates to an oil that does not include tricresyl phosphate and includes as anti-wear additive at least one diphosphorus compound of the formula (I):

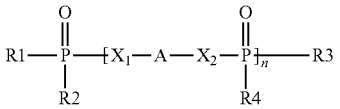

wherein each of R1, R2, R3 and R4 is independently an alkyl or aryl group or an O-alkyl or O-aryl group, A is an alkyl, aryl or aralkyl group, each of $X_1$ and $X_2$ is independently a single bond, an oxygen atom or a nitrogen atom, and n is an integer ranging between 1 and 5.

The different characteristics, variants and embodiments of the invention can be of course associated with one another according to various combinations as long as they are not incompatible or mutually exclusive.

BRIEF DESCRIPTION OF THE FIGURES

FIG. 1 shows molecules resulting from spherical harmonic modeling work. The compounds in the top line belong to cluster 1, the compounds in the bottom line belong to cluster 3.

DETAILED DESCRIPTION

A first object of the invention is the use of an oil that does not include tricresyl phosphate and includes as anti-wear additive at least one diphosphorus compound of the formula (I):

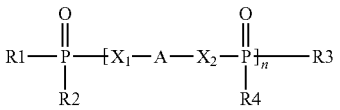

wherein each of R1, R2, R3 and R4 is independently an alkyl or aryl group or an O-alkyl or O-aryl group, A is an alkyl, aryl or aralkyl group, each of $X_1$ and $X_2$ is independently a single bond, an oxygen atom or a nitrogen atom, and n is an integer ranging between 1 and 5, for the prophylaxis of aerotoxic syndrome.

Preferably, the use of an oil according to the invention is for the aerotoxic system prophylaxis in case of fume event.

The invention also relates to a method for the treatment and/or the prophylaxis of aerotoxic syndrome, comprising the use of an oil that does not include tricresyl phosphate and includes as anti-wear additive at least one diphosphorus compound of the formula (I):

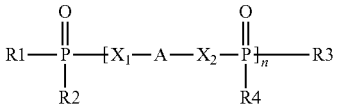

wherein each of R1, R2, R3 and R4 is independently an alkyl or aryl group or an O-alkyl or O-aryl group, A is an alkyl, aryl or aralkyl group, each of $X_1$ and $X_2$ is independently a single bond, an oxygen atom or a nitrogen atom, and n is an integer ranging between 1 and 5.

By "oil" is meant in the present invention any organic material, especially any hydraulic or turbine oil liable to create pollution in the form of gas and/or aerosol in the cabin. In some embodiments, the oil is selected from the group consisting of oils for aircraft or aeroderivative turbines, helicopter transmission oils and weapon fluids. Preferably, in the present invention, the oil is an oil for aircraft or aeroderivative turbines.

In the case of aeroderivative turbines, the pathology referred to as "aerotoxic syndrome" is a pathology comprising at least in part the same neurological symptoms and symptoms related to reproduction as those observed in aircrafts for the aerotoxic syndrome, but which is contracted through exposure to organophosphates such as tricresyl phosphate in plants with industrial turbines on the ground such as offshore platforms.

The oil is preferably used for lubricating aircraft or aeroderivative turbines.

By "alkyl group" is meant a linear or branched saturated hydrocarbon group. Each alkyl group comprises from 1 to 36 carbon atoms ($C_1$ to $C_{36}$), preferably 1 to 18 carbon atoms ($C_1$ to $C_{18}$), preferably 1 to 10 carbon atoms ($C_1$ to $C_{10}$), in particular from 1 to 4 carbon atoms ($C_1$ to $C_4$). Examples of alkyl groups according to the invention include methyl, ethyl, propyl, isopropyl, n-butyl and tert-butyl groups. An alkyl group can be optionally substituted at one or more of its atoms by at least one substituent selected from the group consisting of $C_1$-$C_{18}$ alkyl groups, optionally perfluorinated, hydroxyl group OH, primary $NH_2$ or secondary NHR amine group with alkyl or aryl group R, O-phosphate group such as O-diphenyl phosphate group, and halogen atoms.

Substituting alkyl or aryl groups in the diphosphorus compounds used according to the present invention by each kind of substituent gives the compound the desired properties. For example, the halogen atom substitution could improve the extreme pressure and/or anti-wear effects of the compounds.

By "O-alkyl group" is meant an alkyl group linked to the rest of the molecule via an oxygen atom.

By "aryl group" is meant a carbon-containing aromatic monocyclic or polycyclic group, optionally interrupted by one or more heteroatoms which can be selected, in particular, from the group consisting of nitrogen atom, oxygen atom and sulfur atom. Each aromatic or polyaromatic ring comprises from 5 to 14 atoms. Each ring can be optionally substituted at one or more of its atoms by at least one substituent selected from the group consisting of $C_1$-$C_{18}$ alkyl groups, optionally perfluorinated, hydroxyl group OH, primary $NH_2$ or secondary NHR amine group with alkyl or aryl group R, O-phosphate group such as O-diphenyl phosphate group O—P(═O)$(OPh)_2$, and halogen atoms.

When the aryl group is a polycyclic group wherein at least two rings are linked through at least one covalent bond between two distinct atoms each belonging to one of the rings, the covalent bond between the two rings may be interrupted by at least one alkyl group such as a $C(CH_3)_2$ group, a carbonyl group or a heteroatom or heteroatomic group such as an oxygen atom, a sulfur atom, an amine group NH or NR or a sulfite group OS(═O)O.

By "O-aryl group" is meant an aryl group linked to the rest of the molecule via an oxygen atom.

Examples of monocyclic aryl groups include phenyl group.

When A is or comprises a monocyclic aryl group such as a phenyl, thiophene or pyridine, $X_1$ and $X_2$ are preferably diametrically opposed, in particular at the 1,4-position when the monocyclic aryl group comprises 6 atoms. A is preferably a 1,4-phenyl group.

When A is or comprises a polycyclic group, or a polyaromatic group comprising for example two fused rings, such as naphthalene, $X_1$ and $X_2$ are preferably diametrically opposed in order to maximize the distance between $X_1$ and $X_2$.

In some embodiments, at least one of R1, R2, R3 and R4 is an alkyl or O-alkyl group. In this case, preferably each alkyl group is an alkyl group comprising 8 to 22 carbon atoms ($C_8$ to $C_{22}$).

In some preferred embodiments, at least one of R1, R2, R3 and R4 is an aryl or O-aryl group. Preferably, at least two of R1, R2, R3 and R4 are aryl or O-aryl groups. In particular, R1, R2, R3 and R4 are four aryl or O-aryl groups.

In some embodiments, at least one of R1, R2, R3 and R4 is an unsubstituted phenyl group. Preferably, R1, R2, R3 and R4 are unsubstituted phenyl groups.

In some embodiments, at least one of R1, R2, R3 and R4 is an unsubstituted O-phenyl group. Preferably, R1, R2, R3 and R4 are unsubstituted O-phenyl groups.

In some embodiments, at least one of R1, R2, R3 and R4 is a substituted aryl group.

Examples of polycyclic aryl groups include the 4,4'-biphenyl, 4,4'-diphenylthioether, 4,4'-diphenylether, 4,4'-diphenylphenylethylidene, 4,4'-dimethyldiphenylmethylidene, 4,4'-diphenylsulfone, 4,4'-benzophenone, 2,2'-benzophenone, 1,4-naphthalene, 1,3-naphthalene, 2,7-naphthalene, 2,6-anthracene, 9,10-anthracene and phenanthrene.

By "aralkyl group" is meant an alkyl group covalently linked to an aryl group. Examples of aralkyl groups include the 4,4'-[diphenyl(dimethyl)methylidene)] and 4,4'-diphenylhexafluoropropane group.

In some embodiments, A is selected from the group consisting of a 1,4-phenyl, 4,4'-biphenyl, 4,4'-diphenylthioether, 4,4'-diphenylether, 1,3-(5 O-[(diphenyl)phosphate)] phenyl, 1,3-(2-ethyl-2-butyl)propyl, 1,342-ethyl-2-[methyl-O-diphenyl phosphate])propyl, 4,4'-[diphenyl(dimethyl)-methylidene], 2,2'-benzophenone, 2,7-naphthalene, 1,2-ethyl, 4,4'-[diphenylphenylethylidene], 4,4'-diphenylsulfone, 4,4'-diphenyl-hexafluoropropane, 1,4-[(2-phenyl)phenyl], 1,4[(2,5-ditertbutyl)phenyl], 1,4-[(2-chloro)phenyl], 4,4'-benzophenone, 1-hydroxy-3-thiophenyl, 1,6-hexyl, 1,4-naphthalene, 2,6-anthracene, 9,10-anthracene, 1,10-decyl, 2,5-dimethyl-2,5-hexyl, 1,12-dodecyl and 1,3-naphthalene group.

In some preferred embodiments, A is selected from the group consisting of a 1,4-phenyl, 4,4'-biphenyl, 4,4'-diphenylthioether, 4,4'-diphenylether, 1,3-(5 O-[(diphenyl)phosphate)]phenyl, 1,3-(2-ethyl-2-butyl)propyl, 1,3-(2-ethyl-2-[methyl-O-diphenylphosphate])propyl, 4,4'-[diphenyl (dimethyl)methylidene], 2,2'-benzophenone, 2,7-naphthalene and 1,2-ethyl group.

In some more preferred embodiments, A is selected from the group consisting of a 1,4-phenyl, 4,4'-biphenyl, 4,4'-diphenylthioether, 4,4'-diphenylether, 1,3-(5 O-[(diphenyl) phosphate)]phenyl, 1,3-(2-ethyl-2-butyl)propyl, 1,3-(2-ethyl-2-[methyl-O-diphenylphosphate])propyl group.

In particular, A is selected from the group consisting of a 4,4'-diphenylthioether, 4,4'-diphenylether, 1,3-(5 O-[(diphenyl)phosphate)]-phenyl, 1,3-(2-ethyl-2-butyl)propyl, 1,3-(2-ethyl-2-[methyl-O-diphenylphosphate])propyl group.

In an embodiment, A is an optionally substituted alkyl group, a substituted monocyclic aryl group or a polycyclic aryl group wherein at least two rings are linked by at least a covalent bond between two distinct atoms each belonging to one of the rings, the covalent bond between the two rings being interrupted by at least one heteroatom or heteroatomic group.

By "halogen atom" is meant an atom selected from the group consisting of chlorine, bromine, fluorine and iodine.

Each of $X_1$ and $X_2$ is independently selected from the group consisting of a single bond, an oxygen atom and a nitrogen atom. In some preferred embodiments, $X_1$ and $X_2$ are two oxygen atoms; in other embodiments, $X_1$ and $X_2$ are two nitrogen atoms; finally, in last embodiments, one of $X_1$ and $X_2$ is an oxygen atom and the other of $X_1$ and $X_2$ is a nitrogen atom.

When $X_1$ or $X_2$ is a nitrogen atom, it may be in the form of an NH or NR group, R being an alkyl or aryl group.

When $X_1$ or $X_2$ is a single bond, it means that A is directly linked by only one single bond to the phosphorus atom of the P(═O)R1R2 or P(═O)R3R4 group.

n is an integer comprised between 1 and 5. n may in particular be equal to 1, 2, 3, 4 or 5. In some embodiments, n is 1. When the value of n is not explicitly specified, a diphosphorus compound refers to at least one of the oligomers comprising 1 to 5 —$X_1$-A-$X_2$—P(O)R4-units, or any mixture of at least two of these. For example, it can be a mixture of oligomers comprising 1 to 3 —$X_1$-A-$X_2$—P(O) R4-units.

In some embodiments, the diphosphorus compounds used according to the invention are aryl diphosphates, i.e. they are such that $X_1$ and $X_2$ are two oxygen atoms, and each of R1, R2, R3 and R4 is an optionally substituted O-aryl group.

Surprisingly, non-toxicity, particularly non-neurotoxicity and non-reprotoxicity of the diphosphorus compounds of the formula (I), was demonstrated by the Applicant.

Anti-wear properties of some diphosphorus compounds, including aryl diphosphates, are known in the art and have been already demonstrated previously. Thus, diphosphorus compounds, including arylic diphosphorus compounds, have an anti-wear effectiveness at least as interesting as the one obtained with conventional anti-wear additives such as TCP.

The term "aerotoxic syndrome prophylaxis" refers to the decrease in the occurrence and/or the intensity, or the virtual or total disappearance, of at least one symptom identified as being related to acute or chronic exposure of individuals to the air of aircraft cabin contaminated by oils such as turbine oils or hydraulic oils in the form of gases and/or aerosols. In some embodiments, aerotoxic syndrome prophylaxis means the decrease in the occurrence, or the virtual or total disappearance, of several symptoms, preferably, of all symptoms, identified as being related to acute or chronic exposure of individuals to the air of aircraft cabin contaminated by oils such as turbine oils or hydraulic oils in the form of gases and/or aerosols.

In particular, the symptom can be a neurological, neurobehavioral, neuromotor symptom and/or a symptom related to reproduction. Symptoms whose occurrence and/or intensity may be diminished by the use according to the invention include for example psychological or psychosomatic disorders, chronic fatigue syndrome, severe migraine headaches, multiple chemical sensitivity, mystery viral infections, sleep disorders, depression, stress and anxiety.

The term "fume event" refers to acute or chronic exposure, preferably acute, of at least one individual to the air of aircraft cabin contaminated by oils such as turbine oils or hydraulic oils in the form of gases and/or aerosols. A fume event, if it is significant, can in particular be detected by the perception of an unpleasant characteristic odor, typical of "dirty socks" or "wet dogs". In the most severe cases, for example, following the breakage of a bearing in the turbine, a smoke or thick white mist could be visible.

The expression "an oil that does not include tricresyl phosphate" refers to an oil in which the amount of tricresyl phosphate, regardless of its type of substitution (ortho, meta, para) is less than the detection limit of usual analytical techniques such as for example the gas chromatography-mass spectrometry. A technique suitable for detecting tricresyl phosphate in oil is described for example in De Nola G. et al. *J. Chromatogr. A* 2008; 1200 (2), p. 211-216.

In some embodiments, the oil used according to the invention does not substantially comprise, preferably does not comprise, any aryl monophosphate anti-wear additive.

In some embodiments, the oil used according to the invention does not substantially comprise, preferably does not comprise, organophosphate anti-wear additive other than the diphosphorus compound additive(s).

In some embodiments, the oil used according to the invention does not substantially comprise, preferably does not comprise, anti-wear additive other than the diphosphorus compound additive(s).

In an embodiment, the diphosphorus compound in the oil used according to the invention is selected from the group consisting of:

hydroquinone bis(diphenylphosphate) HDP,
4,4'-dihydroxybiphenyl bis(diphenylphosphate) and oligomers thereof,
4,4'-dihydroxydiphenyl thioether bis(diphenylphosphate),
4,4'-dihydroxydiphenyl ether bis(diphenylphosphate),
1,3,5-phloroglucinol tris(bis(diphenylphosphate)),
2-butyl 2-ethyl 1,3-propanediol bis(diphenylphosphate),
trimethylol propane tris(diphenylphosphate),
4,4'-dihydroxydiphenyl phenylethylidene bis(diphenylphosphate),
4,4'-dihydroxydiphenyl sulfone bis(diphenylphosphate),
4,4'-dihydroxybenzophenone bis(diphenylphosphate),
2,2'-dihydroxybenzophenone bis(diphenylphosphate),
4,4'-dihydroxydiphenyl hexafluoropropane bis(diphenylphosphate),
1,4-dihydroxynaphthalene bis(diphenylphosphate),
1,3-dihydroxynaphthalene bis(diphenylphosphate),
2,7-dihydroxynaphthalene bis(diphenylphosphate),
ethanolamine diphenylphosphate diphenylphosphoroamidate,
4,4'-diaminodiphenyl ether bis(diphenylphosphoroamidate),
2,6-dihydroxyanthracene bis(diphenylphosphate),
9,10-dihydroxyanthracene bis(diphenylphosphate),
1,4-dihydroxy[(2-phenyl)phenyl] bis(diphenylphosphate),
1,4-dihydroxy[(2,5-diterbutyl)phenyl] bis(diphenylphosphate),
1,4-dihydroxy[(2-chloro)phenyl] bis(diphenylphosphate),
1,3-dihydroxythiophene bis(diphenylphosphate),
1,6-hexanediol bis(bis(diphenylphosphate),
1,10-decanediol bis(diphenylphosphate),
2,5-dimethyl 2,5-hexanediol bis(diphenylphosphate), and any mixtures thereof.

In an embodiment, the diphosphorus compound in the oil used according to the invention is selected from the group consisting of:

hydroquinone bis(diphenylphosphate) HDP,
4,4'-dihydroxybiphenyl bis(diphenylphosphate) and oligomers thereof,
4,4'-dihydroxydiphenyl thioether bis(diphenylphosphate),
4,4'-dihydroxydiphenyl ether bis(diphenylphosphate),
1,3,5-phloroglucinol tris(bis(diphenylphosphate)),
2-butyl 2-ethyl 1,3-propanediol bis(diphenylphosphate),
trimethylol propane tris(diphenylphosphate), 2,2'-dihydroxybenzophenone bis(diphenylphosphate),
2,7-dihydroxynaphthalene bis(diphenylphosphate),
ethanolamine diphenylphosphate diphenylphosphoroamidate,
4,4'-diaminodiphenyl ether bis(diphenylphosphoroamidate), and
any mixtures thereof.

In an embodiment, the diphosphorus compound in the oil used according to the invention is selected from the group consisting of:
hydroquinone bis(diphenylphosphate) HDP,
4,4'-dihydroxybiphenyl bis(diphenylphosphate) and oligomers thereof,
4,4'-dihydroxydiphenyl thioether bis(diphenylphosphate),
4,4'-dihydroxydiphenyl ether bis(diphenylphosphate),
1,3,5-phloroglucinol tris(bis(diphenylphosphate)),
2-butyl 2-ethyl 1,3-propanediol bis(diphenylphosphate),
trimethylol propane tris(diphenylphosphate), and
any mixtures thereof.

In an embodiment, the diphosphorus compound in the oil used according to the invention is selected from the group consisting of:
4,4'-dihydroxydiphenyl thioether bis(diphenylphosphate),
4,4'-dihydroxydiphenyl ether bis(diphenylphosphate),
1,3,5-phloroglucinol tris(bis(diphenylphosphate)),
2-butyl 2-ethyl 1,3-propanediol bis(diphenylphosphate),
trimethylol propane tris(diphenylphosphate), and
any mixtures thereof.

Diphosphorus compounds are present in the oil used in the present invention in such an amount as those conventionally used in the art. For example, they can be used in an amount of from 0.1 to 10 wt. %, preferably 0.5 to 5 wt. % based on the total weight of the oil.

The oil used according to the invention may comprise all the conventional constituents and additives known in the art for this type of oil.

The oil used according to the invention preferably comprises an ester base, at least one amine antioxidant, and at least one diphosphorus anti-wear additive of the formula (I).

In some embodiments, the oil used according to the invention also comprises at least one further additive. The at least one further additive can especially be selected from the group consisting of lubricant agents, other anti-wear additives, antioxidants, metal corrosion inhibitors, passivators, viscosity index improvers, detergents or dispersing agents, defoamers, surfactants, blowing agents, tackifiers, stabilizers, bulking agents, hydrolysis stabilizers, additives suitable for extreme pressures, pigments and odor-masking agents. Such additives and agents are well known to those skilled in the art and are commercially available.

The ester base is a conventional ester base well known in the art. It is typically synthetic oil that can be selected from monohydric alcohol or polyhydric alcohol esters, preferably polyhydric alcohol esters, with a mono or dicarboxylic acid reagent.

Particularly suitable polyhydric alcohols are neopolyols such as neopentyl glycol, 2-ethyl-2-methylpropane-1,3-diol, trimethylol ethane, trimethylol propane, trimethylol butane and mono-, di- or tri-pentaerythritol.

Other suitable polyhydric alcohols include any polyhydric alcohol of the formula $$R(OH)p$$

wherein R is an optionally substituted linear, branched or cyclic aliphatic hydrocarbon moiety, and p is an integer equal to or greater than 2. The polyhydric alcohol can be selected from the group consisting of 2-ethyl-1,3-hexanediol, 2-propyl-3,3-heptanediol, 2-butyl-1,3-butanediol, 2,4-dimethyl-1,3-butanediol, ethylene glycol, propylene glycol and polyalkylene glycols.

Particularly suitable monohydric alcohols are neoalcohols such as 2,2,4-trimethylpentanol and 2,2-dimethylpropanol. Alternatively, the monohydric alcohol can be selected from the group consisting of the methyl, butyl, isooctyl and octadecyl alcohols.

The carboxylic acid reagent used to form the ester with the monohydric or polyhydric alcohol can be selected from optionally substituted aliphatic carboxylic acids comprising one or two carboxylic acid functions or any mixtures thereof. The person skilled in the art will know how to select the carboxylic acids to be used depending on the desired properties for the ester and on the monohydric or polyhydric alcohol used.

Ester bases that may be contained in an oil used according to the invention include the octyl acetate, decyl acetate, octadecyl acetate, methyl myristate, butyl stearate, methyl oleate monoesters, as well as the dibutyl phthalate, dioctyl adipate, di-2-ethylhexyl azelate and ethylhexyl sebacate polyesters. Polyol ester-type base oil can be an oil prepared from technical pentaerythritol or trimethylol propane and a carboxylic acid mixture having from 4 to 12 carbon atoms. The technical pentaerythritol is a mixture that comprises from about 85% to 92% by weight of monopentaerythritol and from 8% to 15% by weight of dipentaerythritol.

A commercially available conventional technical pentaerythritol contains about 88% by weight of monopentaerythritol and about 12% by weight of dipentaerythritol, based on the total weight of said ester-type base oil. The technical pentaerythritol may also contain an amount of tri- and tetra-pentaerythritols usually formed as by-products during the technical pentaerythritol production.

Aromatic amine antioxidants are well known in the art and can be monomeric or polymeric aromatic amine antioxidants belonging to the family of aromatic amines and/or phenolic compounds.

Monomeric aromatic amine antioxidants may comprise especially at least one diphenylamine unsubstituted or substituted by at least one hydrocarbon group, at least one naphthylphenylamine unsubstituted or substituted by at least one hydrocarbon group, at least one phenothiazine unsubstituted or substituted by at least one hydrocarbon group, or any mixture thereof. The hydrocarbon groups substituting the amines are ($C_1$-$C_{30}$)alkyl groups, or styrene.

Polymeric aromatic amine antioxidants are the polymerization products of aromatic amine antioxidants as defined above, either with each other or in the presence of a different comonomer. Examples of oligomeric or polymeric aromatic amine antioxidants that can be used in turbine oils according to the invention include those described in the patent applications FR 2 924 122 and WO 2009/071857.

The invention also relates to an oil that does not include tricresyl phosphate and includes as anti-wear additive at least one diphosphorus compound of the formula (I):

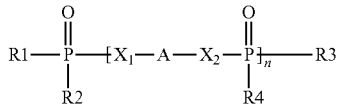

wherein each of R1, R2, R3 and R4 is independently an alkyl or aryl group or an O-alkyl or O-aryl group, A is an alkyl, aryl or aralkyl group, each of $X_1$ and $X_2$ is independently a single bond, an oxygen atom or a nitrogen atom, and n is an integer ranging between 1 and 5, for its use in the prophylaxis of aerotoxic syndrome, especially in case of fume event.

Another subject matter of the invention is an oil that does not include tricresyl phosphate and includes as anti-wear additive at least one diphosphorus compound of the formula (I):

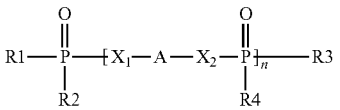

wherein each of R1, R2, R3 and R4 is independently an alkyl or aryl group or an O-alkyl or O-aryl group, A is an alkyl, aryl or aralkyl group, each of $X_1$ and $X_2$ is independently a single bond, an oxygen atom or a nitrogen atom, and n is an integer ranging between 1 and 5.

Of course, the different embodiments described above for the diphosphorus compounds in the section on the use of the oil also apply to the oil for its use in the prophylaxis of aerotoxic syndrome as fume event and to the oil as such.

In particular, in an embodiment, the oil according to the invention is such that A is an optionally substituted alkyl group, a substituted monocyclic aryl group or a polycyclic aryl group wherein at least two rings are linked by at least one covalent bond between two distinct atoms each belonging to one of the rings, the covalent bond between the two rings being interrupted by at least one heteroatom or heteroatomic group.

In the present invention, unless otherwise specified, the term "comprise" and its derivatives are to be understood as non-limiting and not excluding the presence of other components or steps. In some particular embodiments, the term "comprise" can be understood as "essentially consist of" or "consist of".

Unless otherwise specified, intervals mentioned in the present invention are understood to be inclusive.

EXAMPLES

Example 1: Toxicity Study

The diphosphorus compounds according to the invention were studied and compared to other phosphorus compounds, including to TCP, in terms of cholinesterase inhibition, 3D molecular modelling by spherical harmonics, and in terms of QSAR modelling for the neurotoxicity and the reprotoxicity. The correlation between the results obtained made it possible to determine a "safety level" for the use of these compounds as anti-wear agent in oils for aircraft or aeroderivative turbines.

Protocol of the Different Tests Performed:

Inhibitory Concentration Measurement on Two Cholinesterases:

In the extent that the toxic activity of TCP especially involves its action on cholinesterases, the effect of the compounds used according to the invention, as well as comparative compounds, on two cholinesterases was studied. The concentration values of each compound required to inhibit 50% of the activity of two cholinesterases were measured. The higher the 50% inhibitory concentration ($IC_{50}$), the less the compound is neurotoxic since it has a weaker action on the cholinesterase.

The inhibitory capacity of the compounds on the acetylcholinesterase (AChE) and butyrylcholinesterase (BuChE) biological activity was assessed using the spectrometric method of Ellman (Ellman et al., *Biochem. Pharm.* 1961, 7, 88-95).

The acetylthiocholine and butyrylthiocholine iodide, and 5,5-dithiobis (2-nitrobenzoic) acid (DTNB) were purchased from Sigma Aldrich (Steinheim, Germany).

The BuChE freeze-dried from equine serum (eqBuChE, Sigma Aldrich) was dissolved in 0.1M phosphate buffer (pH 7.4) to obtain enzyme stock solutions with an enzymatic activity of 2.5 units/mL. The human erythrocyte AChE (hAChE, aqueous buffer solution, ≥500 units/mg of protein (BCA), Sigma Aldrich) was diluted in 20 mM HEPES buffer, pH 8, with 0.1% Triton X-100 to obtain enzymatic solution with an enzymatic activity of 0.25 unit/mL.

In the procedure, 100 μL of 0.3 mM DTNB dissolved in phosphate buffer, pH 7.4, were added in 96-well plates, followed by 50 μL solution of the test compound and 50 μL enzyme (final 0.05 U). After 5 minutes of pre-incubation at 25° C., the reaction was initiated by injecting 50 μL of 0.1 mM acetyl or butyryl thiocholine iodide solution. The acetyl or butyryl thiocholine hydrolysis was followed by the formation of yellow 5-thio 2-nitrobenzoate anion as the product of the reaction of DTNB with the thiocholine released by the enzymatic hydrolysis of the acetyl or butyryl thiocholine, at a wavelength of 412 nm, using a microplate reader (Synergy 2, Biotek, Colmar, France). The compounds to be tested were dissolved to $5\times10^{-3}$M in analytical grade DMSO. Donepezil or tacrine were used as reference standards. The absorption increase rate at 412 nm was determined 4 minutes after the addition of the acetyl or butyryl thiocholine iodide solution. The tests were carried out with a blank containing all the compounds except the acetyl or butyryl thiocholine in order to take into account non-enzymatic reactions.

The percentage of inhibition due to the presence of the test compounds was calculated using the following expression: $((v0-vi)/v0)\times100$, wherein $v_i$ is the rate calculated in the presence of the inhibitor, and $v_0$ is the enzymatic activity.

$IC_{50}$ values were graphically determined by plotting the percentage of inhibition as a function of the logarithm of six inhibitor concentrations in the test solution using the GraphPadPrism software (version 6.01, GraphPad Software, La Jolla, Calif., USA). All the experiments were carried out in n=3.

Molecular Modelling by Spherical Harmonics

The 3D modelling method used in the invention is described in the publication: "Benchmarking of HPCC: A novel 3D molecular representation combining shape and pharmacophoric descriptors for efficient molecular similarity assessments", Karaboga et al. 2013 Journal of Molecular Graphics and Modelling 41: 20-30.

Two clusters (clusters 1 and 2) were defined by similarity from especially the monophosphate compounds known to be neurotoxic and reprotoxic such as tri(ortho-cresyl)phosphate ToCP, tri(meta-cresyl)phosphate, tri(para-cresyl)phosphate, trixylyl phosphate and saligenin cresyl phosphate.

A third cluster of possibly toxic compounds was identified (cluster 5) including in particular a reprotoxic mutagenic carcinogenic RMC compound such as tri-(n-butylphosphate).

The study of the diphosphorus compounds used according to the invention showed that they belong to a different cluster (cluster 3) related to non-toxic molecules according to the toxicological studies described to date.

Modelling by QSAR

The neurotoxicity and reprotoxicity degrees of various compounds used according to the invention and other monophosphate compounds were assessed by QSAR (Quantitative Structure-Activity Relationship) modelling.

Selection of the Training and Validation Sets

The training set was defined with chemical structures compiled from several publicly available sources: HSBD (Hazardous Substances Data Bank), EPA (U.S. Environmental Protection Agency), ECHA (European Chemicals Agency) and NTP (National Toxicology Program). 247 compounds were classified as neurotoxic compounds, 2214 compounds were classified as reprotoxic compounds and 1697 compounds were classified as neither neurotoxic nor reprotoxic and forming the non-toxic training set.

The validation set was built using compounds derived from data sets different from those used for the training set. The molecules already found in the training set have been removed. The validation set was comprised of 70 compounds classified as neurotoxic compounds, 506 compounds classified as reprotoxic and 256 compounds classified as neither neurotoxic nor reprotoxic and forming the non-toxic validation set.

Performance of the QSAR Model

A Generalized Linear Model (GLM) method has been chosen to perform a Quantitative Structure/Activity Relationship (QSAR) approach. The GLM models were separately trained to discriminate the chemical structures (i) between neurotoxic and non-neurotoxic compounds and (ii) between reprotoxic and non-reprotoxic compounds. This approach resulted in a GLM model with 210 significant descriptors within the training sets. During the training, the performance of the QSAR models was measured by ROC (Receiver Operator Characteristic) curves and gave rise to Area Under Curve (AUC) values of 0.90 and more for the prediction of the neurotoxicity and the reprotoxicity, respectively.

To validate the robustness of the QSAR models, they were then used to predict (i) the neurotoxicity categories of the compounds of the validation set (i.e. neurotoxic/non-neurotoxic categorization), (ii) the reprotoxicity categories of the compounds of the validation set (i.e. reprotoxic/non-reprotoxic categorization). During the validation, the performance of the QSAR models was measured by area under the curve (AUC) values and provided significant values of 0.70 and more for the prediction of the neurotoxicity and the reprotoxicity, respectively.

The GLM-based QSAR models were then used to study the diphosphorus compounds according to the invention.

Synthesis of the Diphosphorus Compounds According to the Invention

In a four-necked flask fitted with a stir bar, a coolant, a separating funnel, a thermowell and a nitrogen bubbler, are introduced 1 molar equivalent of the reagent A (dialcohol, diamine or aminoalcohol) and 3.35 molar equivalents of triethylamine. The reaction medium is diluted with toluene, about 10 volumes relative to the reagent A. Depending on the nature of the reagent A, the reaction medium is heated between 25-110° C. and then, by using the separating funnel, 2.2 molar equivalents of phosphate chloride are introduced dropwise. At the end of the reaction, the triethylamine salt formed is removed by filtration and then washed with 5 volumes of ethyl acetate. Then the filtrate is washed two times with 0.1N HCl solution, two times with 0.1N KOH solution and then with water to neutral pH. The organic layer is then dried with $MgSO_4$, filtered, and then concentrated under reduced pressure. The resulting reaction crude is purified either by silica gel chromatography or by liquid-liquid extraction, or by precipitation. The thus obtained products are characterized by GC (Gas Chromatography) or GPC (Gel Permeation Chromatography) chromatographies, by $^1H$ and/or $^{31}P$-NMR analyses. The yields obtained range from 15 to 75%.

Results

The results of the conducted tests are shown in Table 1 below. The last column corresponds to a risk level score for the safety of these molecules for use in oils such as turbine oils and their alleged cabin toxicity. A score of 5 corresponds to a very high risk in terms of neurotoxicity and/or reprotoxicity, whereas scores of 0 or 1 correspond to a very low or no risk level. The risk level is determined by the sum of the factors corresponding to each of the independently evaluated risks based on the in vitro experimental results of inhibition (hAChE $IC_{50}$ and eqBuChE $IC_{50}$), semi-empirical prediction (neurotoxicity QSAR model and reprotoxicity QSAR model) and molecular modelling via spherical harmonics (clustering) and it can range from 0 to 5. A 0 value indicates a lack of risk, and a 5 value indicates a very high multiple risk. For each risk, a factor 0 or 1 is assigned based on whether the value is above or below a threshold. The following thresholds are applied: 15 mg/L for the $IC_{50}$ for hAChE, 15 mg/L for the $IC_{50}$ for eqBuChE, 0.2% for the neurotoxicity, 3% for the reprotoxicity.

TABLE 1

| Compound | $IC_{50}$ hAChE (mg/L) | $IC_{50}$ eqBuChE (mg/L) | Cluster (spherical harmonics) | QSAR neuro-toxicity (%) | QSAR repro-toxicity (%) | Risk level |
|---|---|---|---|---|---|---|
| Compound A | 12.7 | 0.7 | Cluster 1 | 0.39 | 1.93 | 4 |
| Compound B | 15 | 3.7 | Cluster 1 | 7.35 | 6.28 | 5 |
| Compound C | 9.3 | 2.3 | Cluster 1 | 6.99 | 3.69 | 5 |
| Compound D | 9.7 | 42.7 | Cluster 1 | 8.36 | 0.74 | 3 |
| Compound P | 16.9 | 0.7 | Cluster 1 | Yes | Yes | 4 |
| Compound E | ND | ND | Cluster 1 | 2.23 | 1.41 | ND |
| Compound F | 5.6 | 8.7 | Cluster 1 | ND | ND | >3 |
| Compound G | 15.8 | 145.5 | Cluster 1 | 0.05 | 5.56 | 2 |
| Compound H | 12.1 | 122.8 | Cluster 1 | 0.07 | 3.49 | 3 |
| Compound I | 8.4 | 96 | Cluster 1 | 0.32 | 1.74 | 3 |
| Compound J | ND | 0.7 | Cluster 2 | 5.61 | 1.67 | 4 |
| Compound K | 9.5 | 33.9 | Cluster 2 | 1.13 | 4.4 | 4 |
| Compound 1 | 24.1 | 107 | Cluster 3 | 0.09 | 0.08 | 0 |
| Compound 2 | 25 (n = 1) 83 (n = 1.5) | 101 (n = 1) 159 (n = 1.5) | Cluster 3 | 0 | 0.12 | 0 |
| Compound 3 | 23.2 | 113.2 | Cluster 3 | 0 | 0.04 | 0 |
| Compound 4 | 22.6 | 78.6 | Cluster 3 | 0 | 0.09 | 0 |
| Compound 5 | 22.7 | 82.6 | Cluster 3 | 0.10 | 0.50 | 0 |
| Compound 6 | 16.4 | 58.5 | Cluster 3 | 0 | 0.52 | 0 |
| Compound 7 | 18.3 | 120.2 | Cluster 3 | 0 | 0 | 0 |
| Compound L | 12.2 | 121 | Cluster 5 | 0 | 0.26 | 2 |
| Compound M | 7.9 | 21 | Cluster 5 | 9.98 | 0.23 | 3 |
| Compound N | 8.2 | 89.8 | Cluster 5 | 0.59 | 2980 | ND |
| Compound O | 9.1 | 13.9 | Cluster 5 | 26.31 | 1.82 | 4 |

ND means not determined

The compounds are numbered as follows:

Compound A: 2-ethylhexyl diphenylphosphate

Compound B: Tri(ortho-cresyl)phosphate ToCP

Compound C: Tri(meta-cresyl)phosphate

Compound D: Tri(para-cresyl)phosphate

Compound P: Tricresyl phosphate (Durad 125)

Compound E: Trixylyl phosphate

Compound F: Tri(2,6-difluorophenyl)phosphate

Compound G: Tri(4-isopropylbenzoate)phosphate

Compound H: di(p-tertbutylphenyl)phenylphosphate
Compound I: Tri(p-tert-butylphenyl)phosphate
Compound J: Saligenin cresyl phosphate
Compound K: Diphenyl phosphoroamidate
Compound 1: Hydroquinone bis(diphenylphosphate) HDP
Compound 2: 4,4'-dihydroxybiphenyl bis(diphenylphosphate) BDP and its oligomers
Compound 3: 4,4'-dihydroxydiphenylthioether bis(diphenylphosphate)
Compound 4: 4,4'-dihydroxydiphenylether bis(diphenylphosphate)
Compound 5: 1,3,5-phloroglucinol tris(bis(diphenylphosphate))
Compound 6: 2-butyl-2-ethyl-1,3-propanediol bis(diphenylphosphate)
Compound 7: trimethylolpropane tris(diphenylphosphate)
Compound M: tri(n-butylphosphate)
Compound N: tris(chloroethyl)phosphate
Compound O: tri(isobutyl)phosphate.

Compounds 1 to 7 having the formula (I) according to the invention exhibit high $IC_{50}$ values for hAChE and eqBuChE, belong to a cluster of non-toxic molecules, have low neurotoxicity and low reprotoxicity, and thus a level of risk equal to 0.

Without intending to be bound by any theory, it seems that the structure of the compounds of the formula (I) allow them to achieve a particular tridimensional structure different from that of the toxic compounds such as TCP, which gives them a non-toxic character.

The compounds of the cluster 1 are, according to the spherical harmonic 3D-modelling approach, in the form of "three-blade propeller" based on two planes perpendicular at the molecule center or core while the compounds of the cluster 3 exhibit a rather expanded and planarized shape, similar to a butterfly form. The molecules derived from the modelling work by spherical harmonics are shown in FIG. 1. These compounds are therefore non-neurotoxic and non-reprotoxic alternatives to the tricresyl phosphate and its triaryl phosphate analogs.

Comparatively, the compound I described in the patent application WO2010/149690 has a reduced inhibition on butyrylcholinesterase but is found to be active towards acetylcholinesterase. Modelling classifies the latter as part of the cluster 1, which confirms the experimental result on acetylcholinesterase.

Example 2: Anti-Wear Performance of the Diphosphorus Compounds Used According to the Invention The anti-wear performance of the turbine oils used according to the invention was measured by using the 4-ball wear test in accordance with ASTM D4172 standard test method. The results obtained are shown in Table 2 below.

TABLE 2

| Anti-wear compound formulated as an aviation turbine oil | 4-ball wear (in mm) |
|---|---|
| Without anti-wear additive | 0.83 |
| TCP | 0.46 |
| Compound 1 | 0.45 |
| Compound 2 | 0.45 (n = 1)<br>0.42 (n = 1 to 4, average n = 1.5) |
| Compound 3 | 0.57 |
| Compound 4 | 0.50 |
| Compound 5 | 0.47 |
| Compound 6 | 0.45 |
| Compound 7 | 0.48 |

The results confirm that the diphosphorus compounds used according to the invention in oils have interesting anti-wear properties and potentially similar to those of the TCP, therefore that they are compatible with effective use in oils, especially oils for aircraft or aeroderivative turbines.

Of course, a variety of other modifications may be made to the invention in the context of the appended claims.

The invention claimed is:

1. A method for lubricating aircraft or aeroderivative turbines for reducing the neurotoxicity of an oil comprising:

providing the oil that is free of tricresyl phosphate, the oil comprising as an anti-wear additive at least one polyphosphorus compound of the formula (I):

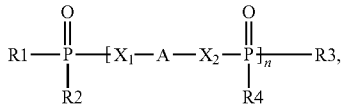

wherein each of R1, R2, R3 and R4 is independently an alkyl or aryl group or an O-alkyl or O-aryl group, A is an alkyl, aryl or aralkyl group, each of $X_1$ and $X_2$ is independently a single bond, an oxygen atom or a nitrogen atom, with the provision that when A is a monocyclic aryl group selected from phenyl, thiophene or pyridine, $X_1$ and $X_2$ are diametrically opposed in order to maximize the distance between $X_1$ and $X_2$, and n is an integer ranging between 1 and 5, wherein the additive is from 0.1 to 10 weight % based on the total weight of the oil; and applying an effective amount of the oil to the aircraft or aeroderivative turbine, wherein the concentration values of the at least one polyphosphorus compound required to inhibit 50% of the activity of human erythrocyte acetylcholinesterase (hAChE) and equine serum butyrylcholinesterase (eqBuChE) are both ≥15 mg/L, assessed using a spectrometric method, and wherein the neurotoxicity and reprotoxicity degrees of the at least one polyphosphorus compound assessed by Quantitative Structure-Activity Relationship (QSAR) modelling applying a Generalized Linear Model (GLM), is ≤0.2% for neurotoxicity and ≤3% for reprotoxicity.

2. The oil according to claim 1, wherein $R_1$, $R_2$, $R_3$ and $R_4$ are unsubstituted O-phenyl groups.

3. The oil according to claim 1, wherein A is selected from the group consisting of a 1,4-phenyl, 4,4'-biphenyl, 4,4'-diphenylthioether, 4,4'-diphenylether, 1,3-(5 O-[(diphenyl) phosphate)]phenyl, 1,3-(2-ethyl-2-butyl)propyl, 1,3-(2-ethyl-2-[methyl-O-diphenylphosphate])propyl, 4,4'-[diphenyl(dimethyl)methylidene], 2,2'-benzophenone, 2,7-naphthalene, 1,2-ethyl, 4,4'-[diphenylphenylethylidene], 4,4'-diphenylsulfone, 4,4'-diphenylhexafluoropropane, 1,4-[(2-phenyl)phenyl], 1,4-[(2,5-ditertbutyl)phenyl], 1,4-[(2-chloro)phenyl], 4,4'-benzophenone, 1-hydroxy-3-thiophenyl, 1,6-hexyl, 1,4-naphthalene, 2,6-anthracene, 9,10-anthracene, 1,10-decyl, 2,5-dimethyl-2,5-hexyl, 1,12-dodecyl and 1,3-naphthalene group.

4. The oil according to claim 1, wherein A is an optionally substituted alkyl group, a substituted monocyclic aryl group or a polycyclic aryl group wherein at least two rings are linked by at least a covalent bond between two distinct atoms each belonging to one of the rings, the covalent bond between the two rings being interrupted by at least one heteroatom or heteroatomic group.

5. The oil according to claim 1, wherein the polyphosphorus compound is selected from the group consisting of:

hydroquinone bis(diphenylphosphate) HDP,
4,4'-dihydroxybiphenyl bis(diphenylphosphate) and oligomers thereof,
4,4'-dihydroxydiphenyl thioether bis(diphenylphosphate),
4,4'-dihydroxydiphenyl ether bis(diphenylphosphate),
1,3,5-phloroglucinol tris(diphenylphosphate),
2-butyl-2-ethyl-1,3-propanediol bis(diphenylphosphate),
trimethylol propane tris(diphenylphosphate),
4,4'-dihydroxydiphenyl phenylethylidene bis(diphenylphosphate),
4,4'-dihydroxydiphenyl sulfone bis(diphenylphosphate),
4,4'-dihydroxybenzophenone bis(diphenylphosphate),
2,2'-dihydroxybenzophenone bis(diphenylphosphate),
4,4'-dihydroxydiphenyl hexafluoropropane bis(diphenylphosphate),
1,4-dihydroxynaphthalene bis(diphenylphosphate),
1,3-dihydroxynaphthalene bis(diphenylphosphate),
2,7-dihydroxynaphthalene bis(diphenylphosphate),
ethanolamine diphenylphosphate diphenylphosphoroamidate,
4,4'-diaminodiphenyl ether bis(diphenylphosphoroamidate),
2,6-dihydroxyanthracene bis(diphenylphosphate),
9,10-dihydroxyanthracene bis(diphenylphosphate),
1,4-dihydroxy[(2-phenyl)phenyl] bis(diphenylphosphate),
1,4-dihydroxy[(2,5-diterbutyl)phenyl] bis(diphenylphosphate),
1,4-dihydroxy[(2-chloro)phenyl] bis(diphenylphosphate),
1,3-dihydroxythiophene bis(diphenylphosphate),
1,6-hexanediol bis(diphenylphosphate),
1,10-decanediol bis(diphenylphosphate),
2,5-dimethyl 2,5-hexanediol bis(diphenylphosphate), and any mixtures thereof.

6. The oil according to claim 1, wherein the oil further comprises an ester base and at least one amine antioxidant.

7. The oil according to claim 1, wherein the oil does not include any anti-wear additive other than the polyphosphorus compound additive(s).

8. The oil according to claim 1, wherein A is an alkyl group, a substituted monocyclic aryl group or a polycyclic aryl group wherein at least two rings are linked by at least a covalent bond between two distinct atoms each belonging to one of the rings, the covalent bond between the two rings being interrupted by at least one heteroatom or heteroatomic group.

9. The oil according to claim 1, wherein the at least one polyphosphorus compound is present in the oil in an amount of from 0.5 to 5 wt. %, based on the total weight of the oil.

* * * * *